US006393779B1

(12) United States Patent
Boldt

(10) Patent No.: US 6,393,779 B1
(45) Date of Patent: May 28, 2002

(54) DOOR FRAME ASSEMBLY AND METHOD OF MOUNTING THE SAME

(75) Inventor: Gary L. Boldt, Green Bay, WI (US)

(73) Assignee: Ex Cell Cellular PVC Building Components, Inc., DePere, WI (US)

( * ) Notice: Subject to any disclaimer, the term of this patent is extended or adjusted under 35 U.S.C. 154(b) by 0 days.

(21) Appl. No.: 09/619,119

(22) Filed: Jul. 19, 2000

(51) Int. Cl.[7] ..... E06B 1/04

(52) U.S. Cl. ..... 52/210; 52/204.1; 52/288.1; 52/717.01; 52/717.05; 52/718.04; 52/745.15

(58) Field of Search ..... 52/204.1, 210, 52/211, 212, 717.01, 717.05, 717.06, 718.04, 718.05, 745.15, 718.01, 287.1, 288.1

(56) References Cited

U.S. PATENT DOCUMENTS

| | | | | | |
|---|---|---|---|---|---|
| 3,654,734 | A | * | 4/1972 | Lehman | 49/501 |
| 4,104,839 | A | * | 8/1978 | Balzer et al. | 52/288 |
| 4,179,849 | A | * | 12/1979 | Kuffner | 49/505 |
| 4,307,543 | A | | 12/1981 | Schulthess | |
| 4,398,373 | A | | 8/1983 | Mancuso | |
| 5,038,538 | A | | 8/1991 | Rozon | |
| 5,058,323 | A | * | 10/1991 | Gerritsen | 49/504 |
| 5,293,723 | A | | 3/1994 | Slessor | |
| 5,345,722 | A | | 9/1994 | McKann | |
| 5,555,682 | A | | 9/1996 | Colitto | |
| 5,603,191 | A | | 2/1997 | Wu | |
| 5,651,223 | A | | 7/1997 | Novak et al. | |
| 5,692,349 | A | | 12/1997 | Guillemet | |
| 5,758,458 | A | * | 6/1998 | Ridge | 52/204.1 |
| 5,787,660 | A | | 8/1998 | Adams | |
| 5,836,118 | A | | 11/1998 | Thornton et al. | |
| 5,894,706 | A | | 4/1999 | Herbst | |
| 5,979,129 | A | | 11/1999 | Azar | |

* cited by examiner

*Primary Examiner*—Beth A. Stephan
*Assistant Examiner*—Naoko Slack
(74) *Attorney, Agent, or Firm*—Michael, Best & Friedrich, LLP; Teresa J. Welch; Jeffrey D. Peterson

(57) ABSTRACT

A door frame assembly and method of mounting the same, which does not require the use of exterior fasteners to secure members of the door frame assembly to a support frame in a doorway of a building. A connecting member is securable to a support frame member. A doorjamb member is attachable to the connecting member. A trim member is attachable to the connecting member and the door jamb member. The connecting combinations between the connecting member, the door jamb member and the trim member are such that once the door frame assembly is fully assembled, the door jamb member and the trim member cannot be disconnected from the support frame member absent an intervening force.

15 Claims, 4 Drawing Sheets

96'
70
92'
100"

DOOR FRAME ASSEMBLY AND METHOD OF MOUNTING THE SAME

FIELD OF THE INVENTION

The present invention relates generally to door frame assemblies for use in doorways of building structures, and methods of mounting the same.

BACKGROUND OF THE INVENTION

Door frame assemblies have been utilized in the building industry for many years. Up until relatively recently, door frame assemblies were almost always constructed of a wood-based members. Although wood is a generally acceptable material, the use of wood has several disadvantages. For example, wood is subject to impact damage, such as denting or splintering upon contact. Wood also has a tendency to deteriorate upon exposure to water, insects, sunlight and various other undesirable influences. In addition, wood is a relatively expensive raw material, and requires labor intensive assembly and finish work. More recently, aluminum, steel and vinyl cladding have been used to cover exterior wood-based door frame assemblies to protect the wood structure from exposure to such noted undesirable influences. However, such cladding simply masks the shortcomings of the existing wood door frame assemblies. Moreover, cladding generally requires time consuming installation, thereby increasing the associated overall cost of the door frame assembly. Even more recently, door frame assemblies manufactured from synthetic materials and composite materials have been produced to replace or compliment wood-based door frame assemblies. However, door frame assemblies made from such synthetic and composite materials often lack the structural integrity of wood-based door assemblies, thereby requiring the use of reinforcing means or additional structural supporting devices.

Consumer demand for economical, low maintenance, yet reliable and aesthetically pleasing, door frame assemblies continues to increase year after year. One way to cut costs associated with building and assembling door frame assemblies is to reduce material costs. Another way to cut costs associated with building and assembling door frame assemblies is to reduce labor time. Thus, there exists a need for a door frame assembly which is economical to manufacture and assemble, which is structurally sound and durable, and which provides a desirable appearance.

SUMMARY OF THE INVENTION

In accordance with the above-described needs and other needs, the present invention solves the noted problems and other problems of the prior art. The present invention provides a door frame assembly and method of mounting the same, which eliminates or minimizes the use of exterior fasteners to secure members of the door frame assembly to a support frame in a doorway of a building. In a preferred embodiment, door jamb members and trim members of the door frame assembly are each made of a solid, single, unitary piece of extruded polyvinyl chloride material.

The invention includes a connecting member which is securable to a support frame member in a door way of a building. A door jamb member is attachable to the connecting member. A trim member is also attachable to the connecting member. The connecting member and the door jamb member have a male/female relationship that allows the door jamb member to be attached to the connecting member without the use of nails, screws or other additional mechanical means. Likewise, the connecting member and the trim member also have a male/female relationship that allows the trim member to be attached to the connecting member without the use of nails, screws or other additional mechanical means. Preferably, the door jam member and the trim member include a male/female relationship, so that the trim member can also be secured to the door jamb member. The connecting relationships between the connecting member, the door jamb member and the trim member, eliminate the requirement for exterior fasteners to secure the door jamb member and the trim member to the associated support frame member in the doorway of the building.

Other features and advantages of the present invention will become apparent to those skilled in the art upon review of the following detailed description, claims and drawings in which like numerals are used to designate like features.

Figure 1:
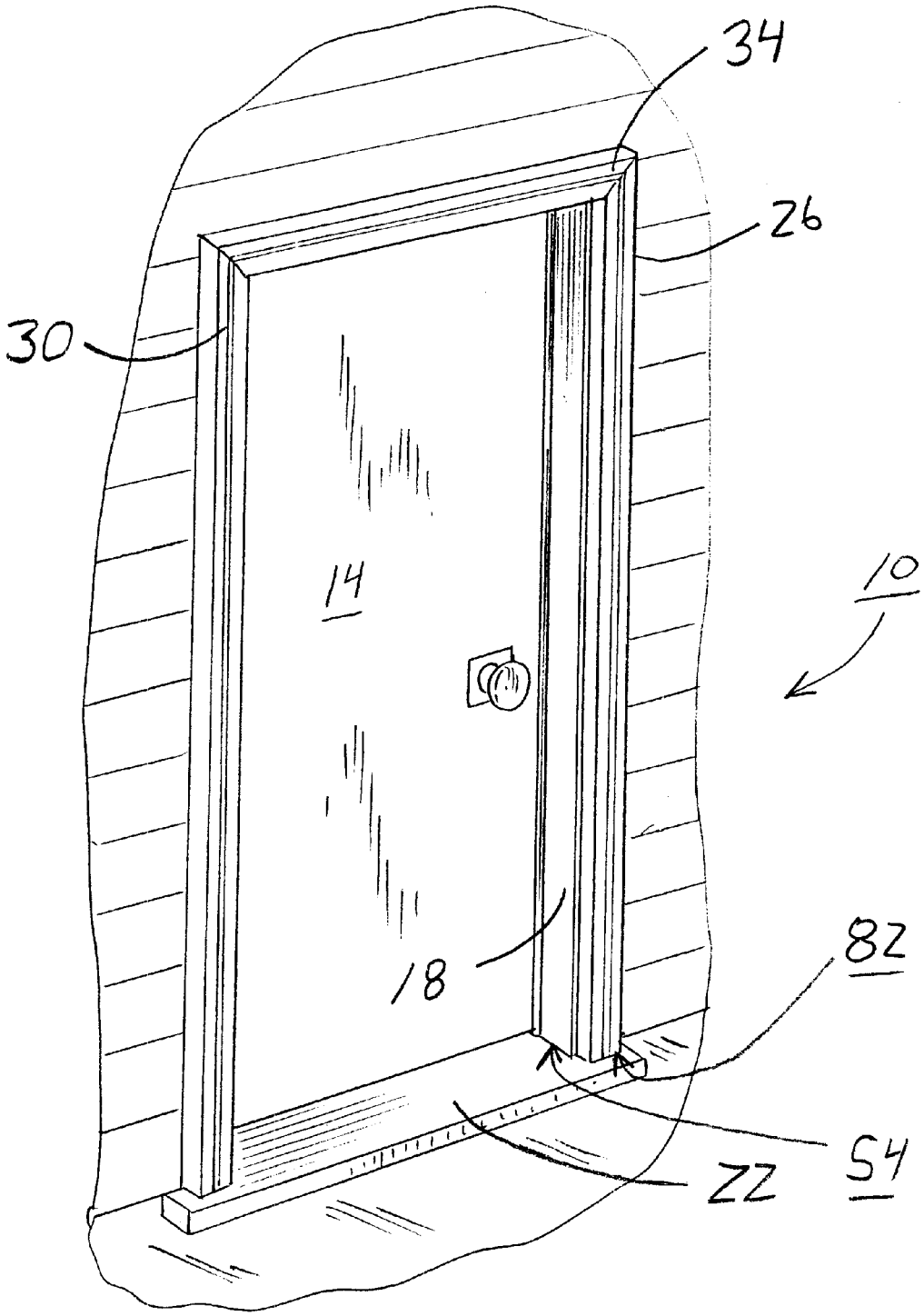
FIG. 1 is a fragmentary, perspective view of a doorway of a building in which the present invention is employed.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" herein is meant to encompass only the items listed thereafter and the equivalents thereof.

DETAILED DESCRIPTION OF THE PREFERRED EMBODIMENTS

Illustrated in FIG. 1 is a doorway 10 of a building in which the present invention is employed. It being understood that the present invention is capable of use in doorways other than that illustrated in FIG. 1, and that the doorway 10 is merely shown and described as an example of one such doorway. Door frame assemblies 100 (FIGS. 2–3), 100' (FIG. 4) and 100" (FIG. 5) of the present invention support a door 14 (see also, FIGS. 3–4) which is movable between open and closed positions.

With continued reference to FIG. 1, a first vertical door jamb member 18 and a spaced apart, substantially identical, second vertical door jamb member (not shown) extend upwardly from a sill or threshold 22. A head door jamb member (not shown) extends across, and is integral with, the top edges of the vertical door jamb members. The head door jamb member is practically the same as the vertical door jamb members, except the length of the head door jamb member is shorter than the length of the vertical door jamb members. Thus, reference to one door jamb member can be appropriately viewed as reference to the other door jamb members. A first vertical trim member 26, a second, substantially identical vertical trim member 30 and head trim member 34 are positioned adjacent to the associated doorjamb members. The head trim member 34 is practically the same as the vertical trim members, except the length of the head trim member is shorter than the length of the vertical trim members. Thus, reference to one trim member can be appropriately viewed as reference to the other trim members.

Although not shown in FIG. 1, but as can be appreciated, beneath the door jamb members and the trim members is a support frame. The door opening of the doorway 10 is originally defined by the support frame which includes a top wall or top frame member, a pair of opposed side walls or side frame members, and the bottom sill or threshold 22. The door jamb members and the trim members are attached to the support frame in a manner which will be more fully explained below. As can at least partially be observed in FIG. 1, and according to the principles of the present invention, no external fasteners are needed to attach the door jamb members and the trim members to the frame walls of the support frame. Preferably, the door jamb members and the trim members are each made of a solid, single, unitary piece of extruded polyvinyl chloride (PVC) material, but can be made of multiple pieces and of different material. PVC is less susceptible to impact damage than other materials. PVC is also water proof, UV-stable, corrosion resistant, paintable if desired, resistant to mold, mildew or dirt build-up, and resistant to insect infestation. PVC is generally a maintenance free material.

Figure 2:
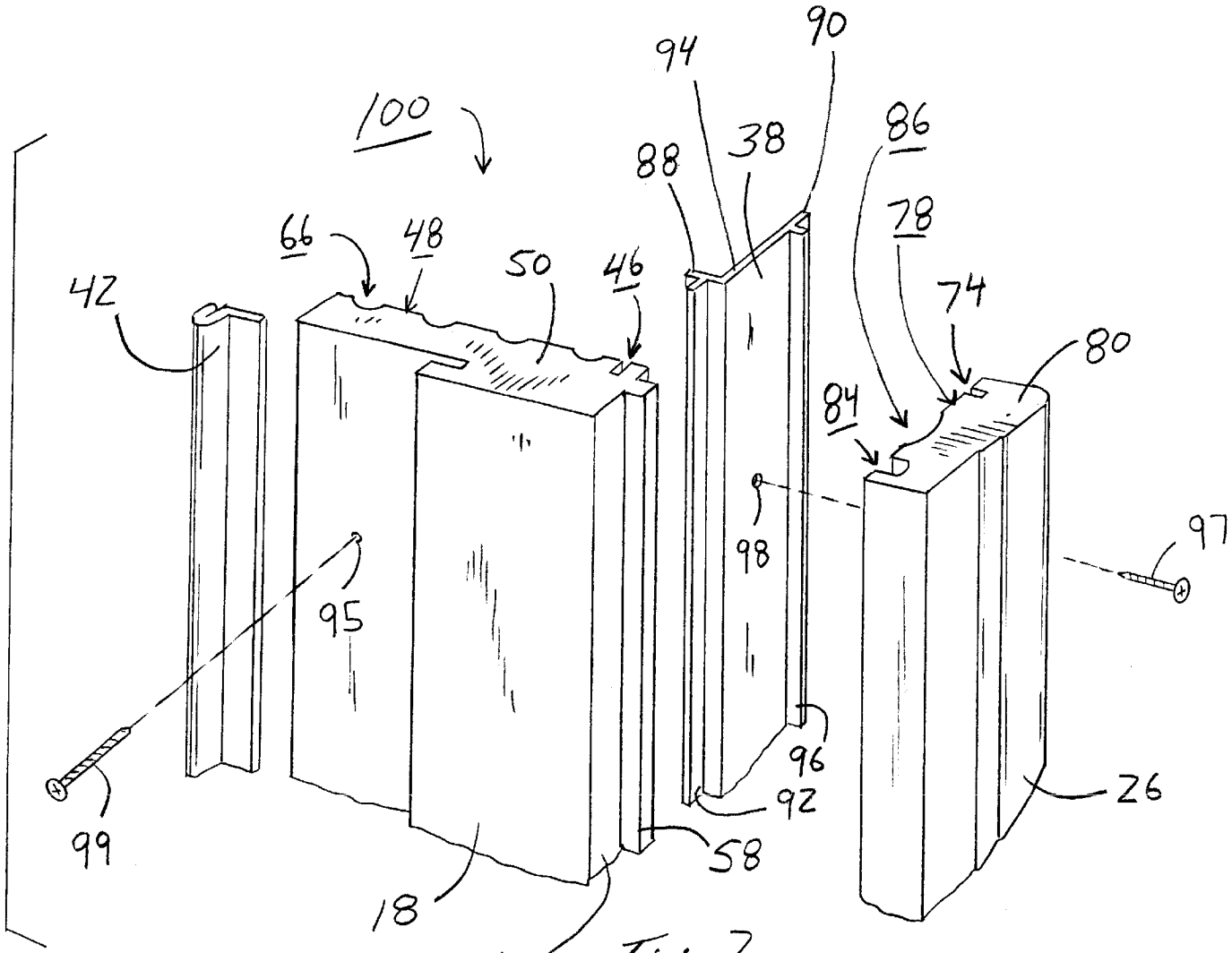
FIG. 2 is a fragmentary, exploded perspective view of a door frame assembly according to the present invention.

FIG. 2 illustrates fragmentary portions of the components of the door frame assembly 100 according to one aspect of the present invention. Shown is the door jamb member 18, the trim member 26, and an associated connecting member or fin 38, it being understood that similar door jamb members, trim members and connecting fins are utilized around an entire doorway. A conventional weather stripping 42, which forms no part of the present invention, is appropriately secured to the door jamb member 18 to provide a seal between the door 14 and the door jamb member 18 as commonly understood (see FIGS. 3–4).

The door jamb member 18 includes a groove 46 in one side 48 thereof; the groove 46 preferably completely extends from the top edge 50 of the door jamb member 18 to the bottom edge 54 (FIG. 1) of the door jamb member 18. It is noted that the top edge 50 and the bottom edge 54 of the door jamb member 18 can be cut or mitered as may be needed (see, e.g., FIG. 1). The door jamb member 18 also includes a projecting member 58 on another side 62 thereof; the projecting member 58 preferably completely extends from the top edge 50 of the door jam member 18 to the bottom edge 54 of the door jamb member 18. The doorjamb member 18 further preferably includes a plurality of recesses 66 in side 48 which abuts a side support frame member 70 (FIGS. 3–5) upon installation. The recesses 66 can be of different shapes and sizes, but the recesses preferably completely extend from the top edge 50 of the door jamb member 18 to the bottom edge 54 of the door jamb member 18. The recesses 66 add strength and rigidity to the doorjamb member 18 when the doorjamb member 18 is attached to the side frame member 70.

The trim member 26 includes a groove 74 in one side 78 thereof; the groove 74 preferably completely extends from the top edge 80 of the trim member 26 to the bottom edge 82 (FIG. 1) of the trim member 26. It is noted that the top edge 80 and the bottom edge 82 of the trim member 26 can be cut or mitered as may be needed (see, e.g., FIG. 1). The trim member 26 also includes a slot 84 in side 78; the slot 84 preferably completely extends from the top edge 80 of the trim member 26 to the bottom edge 82 of the trim member 26. The trim member 26 further preferably includes a recess 86 in side 78 which faces the side support frame member 70 (FIGS. 3–5) upon installation. Recess 86 can be of different shapes and sizes, but the recess 86 preferably completely extends from the top edge 80 of the trim member 26 to the bottom edge 82 of the trim member 26. Recess 86 adds strength and rigidity to the trim member 26 when the trim member 26 is properly attached to the support frame.

The connecting member or fin 38 includes a first elongated leg 88 and a second elongated leg 90 which are arranged to have an "L" shaped cross-section. A locating member 92 projects outwardly from and perpendicular to leg 88; the locating member 92 preferably completely extends from the top edge 94 of the connecting fin 38 to the bottom edge (not shown) of the connecting fin 38. A locating member 96 projects outwardly from and perpendicular to leg 90; the locating member 96 preferably completely extends from the top edge 94 of the connecting fin 38 to the bottom edge of the connecting fin 38. It is noted that the top edge 94 and the bottom edge of the connecting fin 38 can be cut or mitered as may be needed. Preferably, the overall length of the connecting fin 38 corresponds with the overall length of the associated door jamb member 18 and the associated trim member 26. Preferably, the connecting fin 38 is a single, unitary piece of extruded aluminum, but can be made of multiple pieces and of different material.

Figure 3:
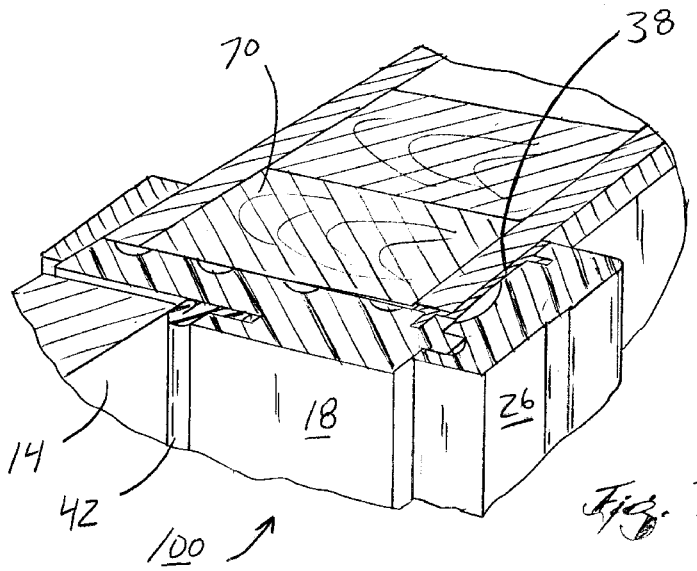
FIG. 3 is a fragmentary, sectional perspective view of an assembled door frame assembly positioned in a doorway, such as the doorway of FIG. 1, according to one aspect of the present invention.

FIG. 3, in conjunction with FIG. 2, illustrates the door frame assembly 100 mounted on the support frame or side support member 70. The connecting fin 38 is secured to a wall member or the side support member 70 with nails, screws 97 or other fastening means (see FIG. 2). The connecting fin 38 can include a plurality of apertures 98 to receive the appropriate fastening means.

The doorjamb member 18 is then secured to the connecting fin 38. The groove 46 of the door jamb member 18 receives the locating member 92 of the connecting fin 38. The groove 46 and the locating member 92 are designed to provide an interference fit, a snap-fit connection or the like, such that once the locating member 92 mates with the groove 46, the door jamb member 18 cannot separate from the connecting fin 38 absent an outside intervening force. FIG. 5 illustrates one such alternative mating relationship, wherein the locating member 92' is provided with a ribbed end. Accordingly, because the connecting fin 38 is firmly secured to the support frame or side support member 70, the door jamb member 18 is secured to the support frame or side support member 70. The door jamb member 18 can be further secured to the support frame or side support member 70 with nails, screws 99 (FIG. 2) or other fastening means for added stability, if so desired. Door jamb member 18 can include a plurality of apertures 95 to receive the appropriate fastening means. It is noted that the exterior fasteners, if utilized, are generally hidden behind a side edge of door 14 (see FIGS. 3–4), so as not to generally require maintenance.

The trim member 26 is then secured to the connecting fin 38. The groove 74 of the trim member 26 receives the locating member 96 of the connecting fin 38. The groove 74 and the locating member 96 are designed to provide an interference fit, a snap-fit connection or the like, such that once the locating member 96 mates with the groove 74, the trim member 26 cannot separate from the connecting fin 38 absent an outside intervening force. FIG. 5 illustrates one such alternative mating relationship, wherein the locating member 96' is provided with a ribbed end. Accordingly, because the connecting fin 38 is firmly secured to the support frame or side support member 70, the trim member 26 is secured to the support frame or side support member 70. The trim member 26 is further secured to the support frame or side support member 70 and the door jamb member 18 by positioning the projecting member 58 of the door jamb member 18 into the slot 84 of the trim member 26. The connecting joint between the projecting member 58 and the slot 84 can be an interference fit, a dovetail joint, a snap-fit connection or any other suitable joint.

Having described the structural components and assembly of the door frame assembly 100, it should be readily apparent that the door frame assembly 100 is designed in such a way that the members of the door frame assembly cannot pull away from the support frame absent an outside intervening force. The use of connecting fins in combination with the associated door jamb members and trim members eliminates the required use of external fasteners, as is the case with prior door assemblies.

Figure 4:
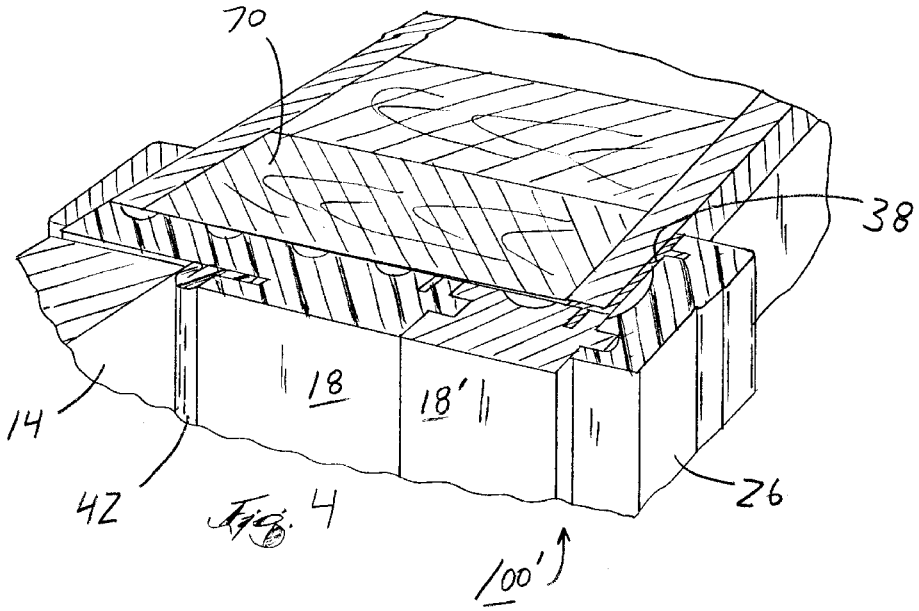
FIG. 4 is a fragmentary, sectional perspective view of an assembled door frame assembly positioned in a doorway, such as the doorway of FIG. 1, according to one aspect of the present invention.
Figure 5:
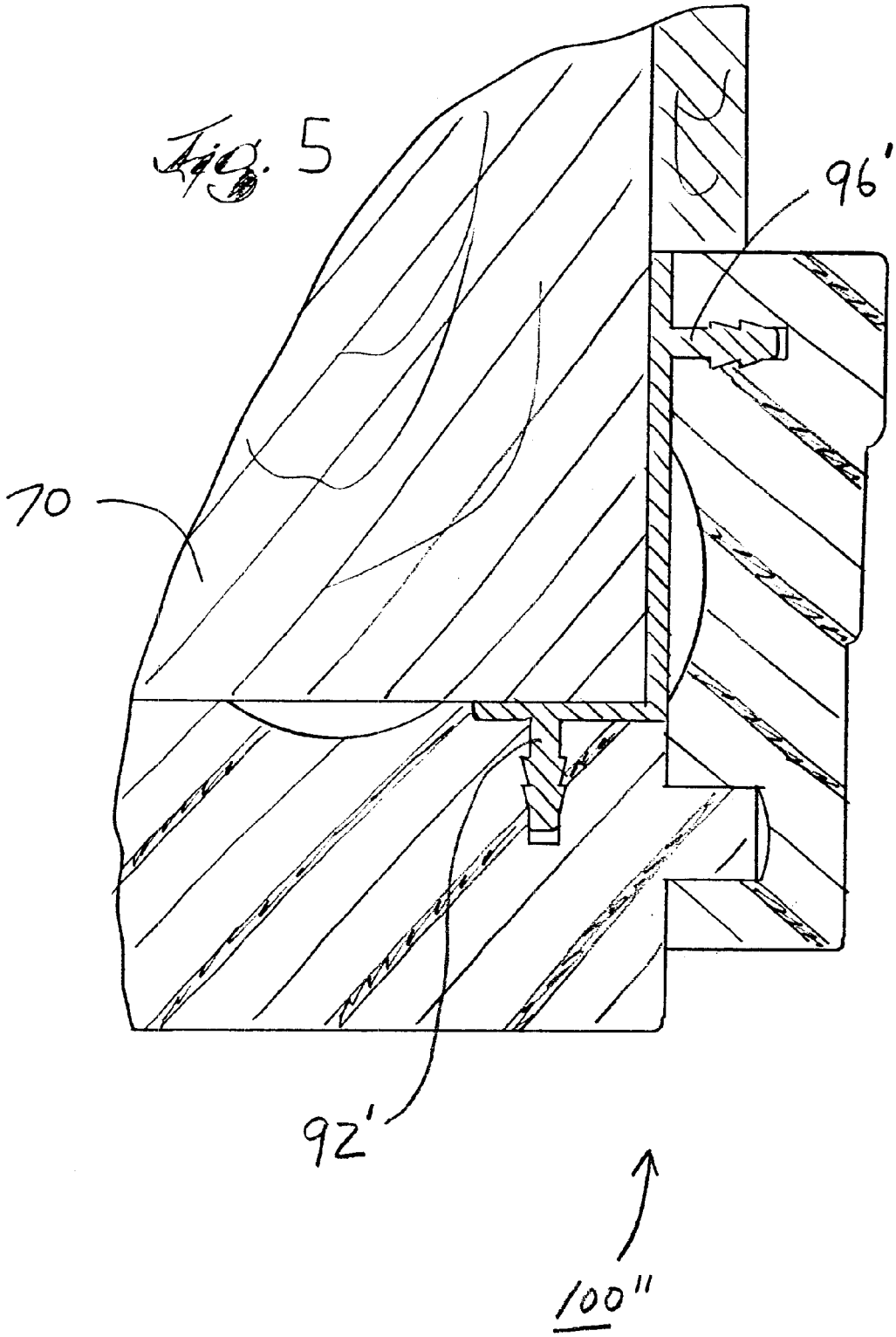
FIG. 5 is a fragmentary, cross-sectional view of an assembled door frame assembly positioned in a doorway, such as the doorway of FIG. 1, according to one aspect of the present invention.

FIG. 4 illustrates a slight modification of the door frame assembly 100 shown in FIGS. 2–3. Door frame assembly 100' includes an extension door jamb member 18'. Door frame assembly 100' accommodates deeper door jamb widths associated with support frames constructed of a 2"×6" construction. Extension door jamb member 18' is generally similar to door jamb member 18. However, as shown, extension door jamb member 18' includes a slot which is similar to slot 84 of trim member 26 for assembly purposes.

As described, the door frame assembly according to the present invention is economical to manufacture, assemble and maintain, yet is also of a reliable construction and aesthetically pleasing.

The foregoing description of the present invention has been presented for purposes of illustration and description. Furthermore, the description is not intended to limit the invention in the form disclosed herein. Consequently, variations and modifications commensurate with the above teachings in skill or knowledge of the relevant art, are within the scope of the present invention. The embodiments described herein are further intended to explain the best modes known for practicing the invention and to enable others skilled in the art to utilize the invention as such, or other embodiments and with various modifications required by the particular applications or uses of the present invention. It is intended that the appended claims are to be construed to include alternative embodiments to the extent permitted by the prior art.

Various features of the invention are set forth in the following claims.

What is claimed is:

1. A door frame assembly for supporting a door movable between opened and closed positions in a door opening defined by a support frame in a doorway of a building, said door frame assembly comprising:

a connecting member having a first leg which includes a first projecting member and a second leg which includes a second projecting member, said second leg extending from and being substantially perpendicular to said first leg, and said connecting member being attachable to the support frame;

a door jamb member having a first side which has a groove and a second side which has a projecting member; and a trim member having a first side which has a groove and a slot, such that when said door frame assembly is assembled, said connecting member is attached to the support frame, said groove of said doorjamb member receives said first projecting member of said connecting member, said groove of said trim member receives said second projecting member of said connecting member, and said slot of said trim member receives said projecting member of said door jamb member, so that said door jamb member and said trim member are secured to the support frame.

2. A door frame assembly according to claim 1, wherein said first leg and said second leg are arranged to have a substantially "L" shaped cross-section.

3. A door frame assembly according to claim 1, wherein said connecting member is a single, unitary piece of extruded aluminum.

4. A door frame assembly according to claim 1, wherein said first projecting member and said second projecting member of said connecting member each include a ribbed shaped end for insertion into the associated door jamb member and trim member.

5. A door frame assembly according to claim 1, wherein said door jamb member and said trim member are each made of a solid, single, unitary piece of extruded, polyvinyl chloride material.

6. A door frame assembly according to claim 1, wherein said first side of said door jamb member and said first side of said trim member each has at least one recess.

7. A door frame assembly according to claim 5, further comprising:

an extension door jamb member having a first side which has a groove, a second side which has a projecting member and a third side which has a slot, such that when said door frame assembly is assembled, said connecting member is attached to the support frame, said groove of said extension door jamb member receives said first projecting member of said connecting member, said groove of said trim member receives said second projecting member of said connecting member, said slot of said trim member receives said projecting member of said extension door jamb member, and said slot of said extension door jamb member receives said projecting member of said door jamb member, so that said extension door jamb member, said door jamb member and said trim member are secured to the support frame.

8. A door frame assembly for supporting a door movable between opened and closed positions in a door opening in a doorway of a building, wherein the door opening is defined by an elongated, horizontally orientated head support member, an elongated, horizontally orientated sill portion spaced apart from said head support member, a first elongated, vertically orientated, side support member and a second, spaced apart, elongated, vertically orientated side support member both of which extend between said head support member and said sill portion, said door frame assembly comprising:

a first connecting fin, a second connecting fin and a third connecting fin, each connecting fin having a first elongated leg which includes a first projecting member which extends substantially the entire length of said first leg and a second elongated leg which includes a second projecting member which extends substantially the entire length of said second leg, wherein said second leg extends from and is substantially perpendicular to said first leg, such that said first connecting fin is attachable to said head support member, said second connecting fin is attachable to one of said side support members and said third connecting fin is attachable to the other side support member;

a first elongated door jamb member, a second elongated door jamb member and a third elongated door jamb member, each door jamb member having a first side which includes a groove that substantially extends between a first end and a second end of the door jamb member, each door jamb member also having a second side which includes a projecting member that substantially extends between said first end and said second end of the door jamb member; and a first elongated trim member, a second elongated trim member and a third elongated trim member, each trim member having a first side which includes a groove and a slot each of which substantially extends between a first end and a second end of the trim member;

wherein when said first connecting fin is connected to said head support member, said second connecting fin is connected to one of said side support members and said third connecting fin is connected to said other side support member, said first door jamb member is attached to said first connecting fin such that the associated groove receives the associated projecting member, said second door jamb member is attached to said second connecting fin such that the associated groove receives the associated projecting member, said third door jamb member is attached to said third connecting fin such that the associated groove receives the associated projecting member, said first trim member is attached to said first connecting fin and said first door jamb member such that said groove of said first trim member receives said second projecting member of said first connecting fin and said slot of said first trim member receives said projecting member of said first door jamb member, said second trim member is attached to said second connecting fin and said second door jamb member such that said groove of said second trim member receives said second projecting member of said second connecting fin and said slot of said second trim member receives said projecting member of said second door jamb member, and said third trim member is attached to said third connecting fin and said third door jamb member such that said groove of said third trim member receives said second projecting member of said third connecting fin and said slot of said third trim member receives said projecting member of said third door jamb member, so that the door jamb members and the trim members are secured to the associated support members.

9. A door frame assembly according to claim 8, wherein said first leg and said second leg of each of said first, second and third connecting fins are arranged to have a substantially "L" shaped cross-section.

10. A door frame assembly according to claim 9, wherein each of said first, second and third connecting fins is a single, unitary piece of extruded aluminum.

11. A door frame assembly according to claim 10, wherein each of said first, second and third door jamb members, and each of said first, second and third trim members are made of a solid, single, unitary piece of extruded, polyvinyl chloride material.

12. A door frame assembly according to claim 11, wherein each of said first sides of each of said door jamb members and said trim members has at least one recesses which substantially extends between the associated first end and the associated second end.

13. A door frame assembly according to claim 8, wherein said first projecting member and said second projecting member of each of said first, second and third connecting fins, each include a ribbed shaped end for insertion into the associated door jamb member and trim member.

14. A door frame assembly according to claim 8, further comprising:

a first elongated extension door jamb member, a second elongated extension door jamb member and a third elongated extension door jamb member, each extension door jamb member having a first side which has a groove that substantially extends between a first end and a second end of the extension door jamb member, a second side which has a projecting member that substantially extends between said first end and said second end of the extension door jamb member and a third side which has a slot that substantially extends between said first end and said second end of the extension door jamb member, such that when said first connecting fin is connected to said head support member, said second connecting fin is connected to one of said side support members and said third connecting fin is connected to said other side support member, said first extension door jamb member is attached to said first connecting fin such that the associated groove receives the associated projecting member, said second extension door jamb member is attached to said second connecting fin such that the associated groove receives the associated projecting member, said third extension door jamb member is attached to said third connecting fin such that the associated groove receives the associated projecting member, said first trim member is attached to said first connecting fin and said first extension door jamb member such that said groove of said first trim member receives said second projecting member of said first connecting fin and said slot of said first trim member receives said projecting member of said first extension door jamb member, said second trim member is attached to said second connecting fin and said second extension door jamb member such that said groove of said second trim member receives said second projecting member of said second connecting fin and said slot of said second trim member receives said projecting member of said second extension door jamb member, said third trim member is attached to said third connecting fin and said third extension door jamb member such that said groove of said third trim member receives said second projecting member of said third connecting fin and said slot of said third trim member receives said projecting member of said third extension door jamb member, said slot of said first extension door jamb member receives said projecting member of said first door jamb member, said slot of said second extension door jamb member receives said projecting member of said second door jamb member and said slot of said third extension door jamb member receives said projecting member of said third door jamb member, so that the extension door jamb members, the door jamb members and the trim members are secured to the associated support members.

15. A method of mounting a door frame assembly in a door opening defined by a top wall, a pair of opposed side walls and a bottom threshold, said method comprising:

securing a connecting member having a first projecting member and a second projecting member onto each wall;

providing a first door jamb member, a second door jamb member and a third door jamb member, each door jamb member having a groove in one side thereof and a projecting member on another side thereof;

attaching said first door jamb member, said second door jamb member and said third door jamb member to an associated connecting member such that said groove in each of the door jamb members receives the associated first projecting member of the associated connecting member;

providing a first trim member, a second trim member and a third trim member, each trim member having a groove and a slot in one side thereof; and attaching said first trim member, said second trim member and said third trim member to an associated connecting member such that said groove in each of the trim members receives the associated second projecting member of the associated connecting member, and such that said slot in each of said trim members receives the associated projecting member of the associated door jamb member.

* * * * *